United States Patent [19]

Dobrzanski

[11] 4,439,683

[45] Mar. 27, 1984

[54] IONIZATION SMOKE DETECTOR

[75] Inventor: John J. Dobrzanski, New Britain, Conn.

[73] Assignee: General Signal Corporation, Stamford, Conn.

[21] Appl. No.: 233,352

[22] Filed: Feb. 11, 1981

[51] Int. Cl.[3] ..... H01J 47/02

[52] U.S. Cl. ..... 250/381; 250/385

[58] Field of Search ..... 250/381, 382, 384, 385

[56] References Cited

U.S. PATENT DOCUMENTS

| | | | |
|---|---|---|---|
| Re. 30,323 | 7/1980 | Tomioka | 250/385 |
| 3,731,093 | 5/1973 | Scheidweiler et al. | 250/384 |
| 3,903,419 | 9/1975 | Lehsten | 250/381 |
| 3,908,957 | 9/1975 | Schütt | 250/384 |
| 3,959,788 | 5/1976 | Tipton et al. | 250/381 |
| 4,044,263 | 8/1977 | Ried, Jr. et al. | 250/381 |

*Primary Examiner*—Alfred E. Smith
*Assistant Examiner*—Carolyn E. Fields
*Attorney, Agent, or Firm*—Ronald Reichman; Milton E. Kleinman; John Ohlandt

[57] ABSTRACT

An ionization smoke detector having a sensing chamber and including: a screen or mesh electrode enclosing and forming the outer limits of said sensing chamber, while fully exposing said sensing chamber to the ambient atmosphere; a baffle means covering said electrode and in close proximity thereto, said baffle means having a plurality of slit-like openings spaced around the periphery thereof for permitting the transfer of ambient atmosphere to said sensing chamber; said openings of said baffle means constituting deflectors oriented to deflect any air currents directed normal to the surface of said baffle means so the air currents will enter said sensing chamber at an angle other than said normal angle.

6 Claims, 4 Drawing Figures

Fig. 1.
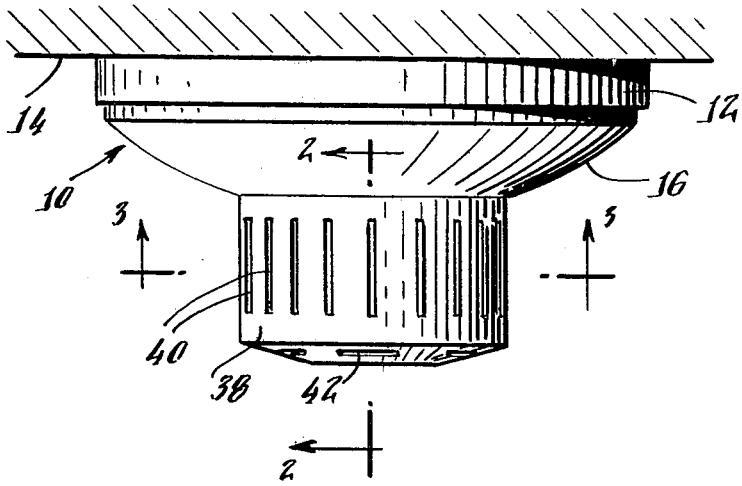
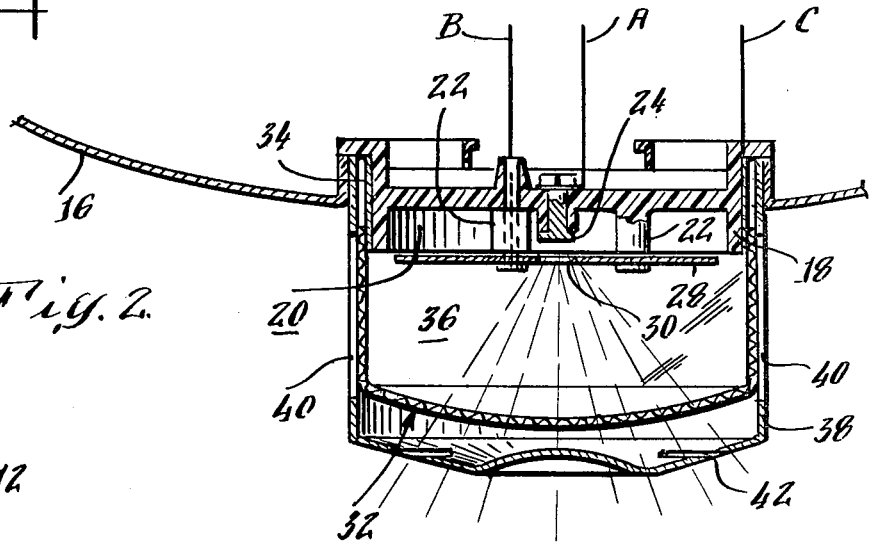
Fig. 2.
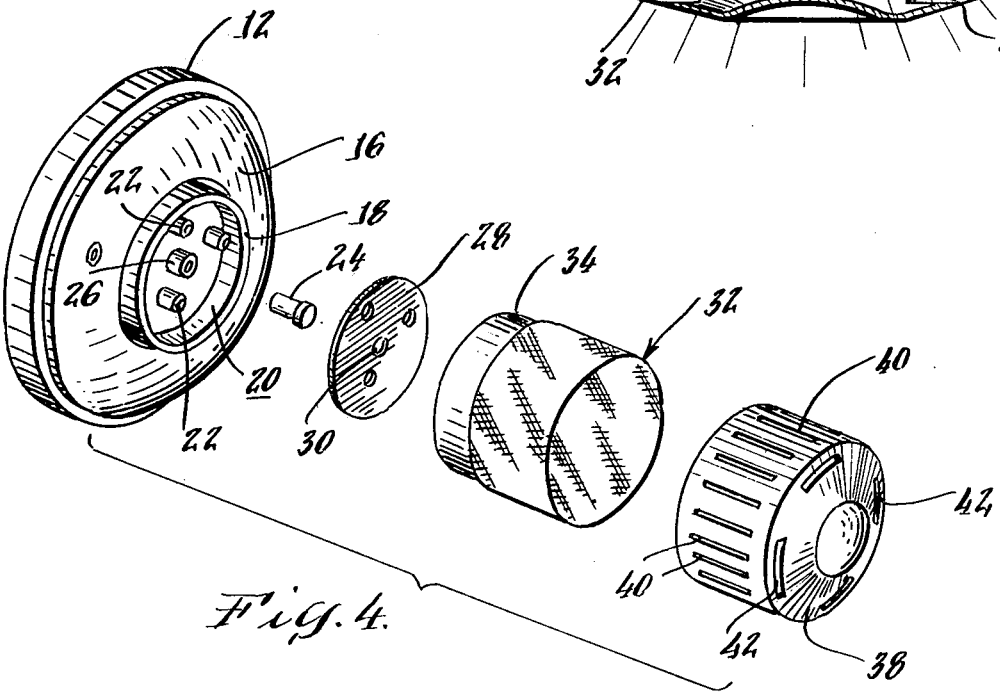
Fig. 4.

IONIZATION SMOKE DETECTOR

BACKGROUND OF THE INVENTION

1. Field of the Invention

This invention relates to an ionization smoke detector device, and more particularly, to that class of devices which are arranged to have a radioactive source and a dual-region ionization chamber irradiated by such source.

As is well known, the principle of an ionization smoke detecting device relies upon the fact that when a gas contained within a limited space is ionized by radioactivity from a suitable source, such as radium or caesium, a resultant ion current can be measured. Changes in the composition of the gas due to the entry of smoke particles or the like can be detected by sensing or detecting a change in the ion current.

The present invention provides a solution to the difficulty which arises in the operation of certain ionization smoke detectors when fairly severe air movements within the detecting chamber take place due to strong gusts of wind or the like occurring in the ambient atmosphere. If not controlled, such air movements produce a false alarm because they simulate a smoke condition; that is to say, the air movements cause the same ionic flow change as smoke would cause, and hence have the same result of triggering an alarm.

Although the present invention will be described in the context of a particular form of ionization detector, it will be understood that the principle is applicable to other types and kinds of detectors.

2. Background Art

For an appreciation of a specific context to which the present invention is applicable, reference may be made to U.S. Pat. Nos. 3,935,492 and 3,935,466. The former describes an ionization smoke detector having two ionization chambers or regions, one of said chambers having an electrode surrounded by a conductive mesh, with a radioactive source being carried by said outer electrode. The latter patent, i.e. U.S. Pat. No. 3,935,466 discloses a similar arrangement, but utilizes a differently shaped intermediate electrode.

Reference may also be made, in connection with the concept of a dual region or dual chamber ionization detector, to U.S. Pat. No. 4,017,733. In that patent a similar scheme to that previously noted in U.S. Pat. No. 3,935,492 is proposed, according to which a cup-like outer electrode member is provided having circumferentially arranged openings or windows and with a plate or disc-like intermediate electrode subdividing the principal chamber into two regions or sections. The smoke sensor or detector of U.S. Pat. No. 4,017,733 has as one of its major objectives the prevention of spurious indications of smoke due, for example, to a comparatively intense air stream which might otherwise cause a change in the normally high impedance present in the chamber.

Another patent of interest, which happens to be referred to in U.S. Pat. No. 4,017,733, is U.S. Pat. No. 3,731,093. The smoke sensing detector therein described utilizes a cup-like, double-wall structure consisting of inner and outer sheathing walls formed with windows at respectively different levels to provide for an appropriate resistance to the flow of an incoming air stream. Accordingly, this U.S. Pat. No. 3,731,093 is also directed to reduce or to weaken the effects of an air stream within a sensing chamber upon ionic flow.

Whatever the merits of the devices or systems of the aforenoted patents, essentially no effective solution has been furnished by these patents with respect to providing a simple structure for a smoke detector, while achieving substantial reduction in undesired effects of air currents entering the ionization chamber.

Accordingly it is a primary object of the present invention to allow ready access of the ambient atmosphere into the smoke detecting chamber of a smoke detector device, while keeping the structure of the device extremely simple and low in cost.

Another basic object is to prevent a false alarm from being given in the situation where occasional strong winds would tend to cause a sharp change in the ionic flow, thus simulating the presence of smoke in the detecting chamber.

SUMMARY OF THE INVENTION

In fulfillment of the above stated objects, a primary feature of the present invention resides in the provision of a sensing chamber within an ionization smoke detector and comprising in combination: a screen or mesh electrode enclosing and forming the outer limits of said sensing chamber, while fully exposing said sensing chamber to the ambient atmosphere; a baffle means covering said electrode and in close proximity thereto, said baffle means having a plurality of slit-like openings spaced around the periphery thereof for permitting the transfer of ambient atmosphere to said sensing chamber; said openings of said baffle means constituting deflectors oriented to deflect any air currents directed normal to the surface of said baffle means so the air currents will enter said sensing chamber at an angle other than said normal angle.

In accordance with a preferred embodiment, the sensing chamber is divided into two regions, the first or reference region being defined between a first, or inner, electrode and a second, or intermediate, electrode spaced from the first; the second region being defined by the intermediate electrode and a third, or outer, electrode, the outer electrode being in the form of a screen.

Other and further objects, advantages and features of the present invention will be understood by reference to the following specification in conjunction with the annexed drawing, wherein like parts have been given like numbers.

BRIEF DESCRIPTION OF THE DRAWING

FIG. 1 is an elevation view illustrating the smoke detector of the present invention mounted on a ceiling or like structure.

FIG. 2 is a vertical sectional view taken on the line 2—2 of FIG. 1.

FIG. 4 is an exploded view of the various components making up the smoke detector assembly.

DESCRIPTION OF PREFERRED EMBODIMENT

Figure 3:
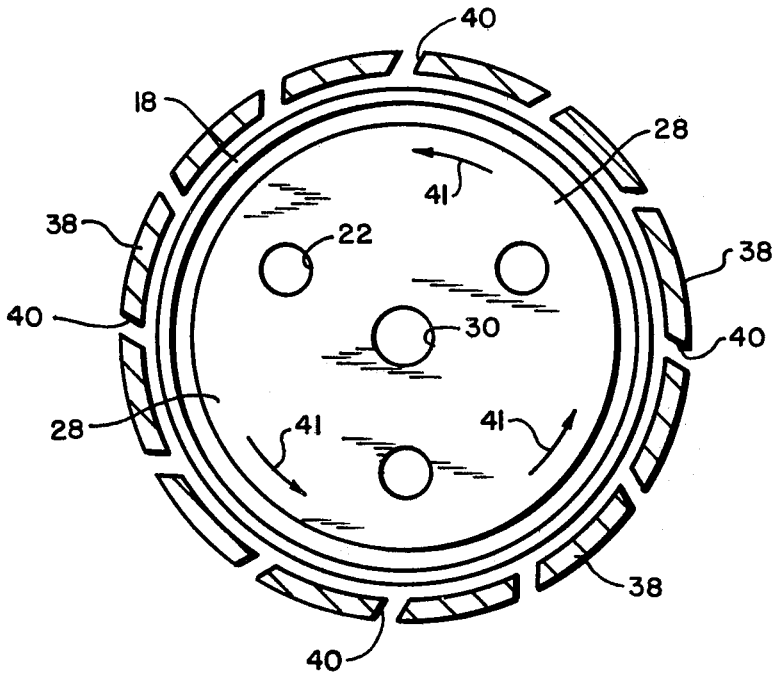
FIG. 3 is a horizontal sectional view taken on the line 3—3 of FIG. 1.

Referring now to the figures, there will be seen a smoke detector device in accordance with a preferred embodiment. The complete device is designated by the numeral 10, including a base member 12 seen flush against a ceiling 14. A shroud 16 depends from the base member and is suitably affixed thereto. At the lower end of the device 10 is a cylindrical portion 18 defining a first region 20 of the smoke detecting chamber. Within the chamber region 20 are three stand-off members 22. A first electrode 24 is received in an opening in cylindrical member 26 centrally located within the region 20.

Contained within the electrode 24 is a typical isotope (0.5 microcurie) for the purpose of providing radiation of alpha paticles within the ionization chamber. As will be understood, an intermediate disc-like electrode 28, spaced an appropriate distance from the end of electrode 24, is suitably attached to the stand-off members 22 such that radiation may proceed in a centrally located conical configuration, as shown, through the opening 30. This intermediate or grid electrode 28 typically has a diameter of 1.69 inches and a thickness of 0.015 inches.

The outer electrode is constituted by a cylindrical screen means 32 comprising a screen or mesh mounted on a shield or base 34 of conductive material. The screen electrode includes a large number of finely sized openings such that the passage of insects is inhibited. Typically, the screen electrode has a diameter of 2.050 inches; the axial gap between intermediate electrode 28 and the outer screen electrode 32 is 0.750 inches. The screen electrode or screen means 32 fits into the assembly such that the shield 34 surrounds and grips the cylindrical portion 18. It will be understood that this outer electrode 32 defines with the intermediate electrode 28 a second region or zone 36 within the detecting chamber.

A cup-like baffle or cover 38 surrounds the outer electrode; formed around the periphery of the baffle is a series of spaced slit-like openings 40 which are vertically oriented in the illustrated position of the device 10. As will be appreciated by reference to FIG. 3, these slits are so formed as to be skewed with respect to the radius of the detecting chamber, preferably at an angle of 60°. In effect then, the skewed slits constitute deflectors which function to deflect any air currents moving substantially parallel to the ceiling 14 and directed normal to the surface of the baffle 38. Consequently any air currents which enter the chamber will do so at an angle other than a normal angle, and thereby tend to circulate mainly around the periphery (as seen by arrows 41), with the result that they do not affect substantially thhe ionic flow which is concentrated in the conical configuration depicted.

Also included in the bottom of the baffle is a series of spaced arcuate slits or openings 42, also provided to allow for access of ambient atmosphere to the ionization chamber, but located to insure that air currents substantially normal to the ceiling 14 which enter the chamber will do so at the periphery and will likewise not substantially affect ionic flow.

Terminal connections are made, by way of the lugs or conductors A, B, and C, to a field effect transistor; specifically, to the drain, gate and source electrodes respectively, of such a transistor, for purposes of detecting voltage change occurring as a result of smoke presence in the chamber. Such field effect transistor (not seen here) is connected in a suitable detector circuit; for example, in the circuit disclosed in copending U.S. application Ser. No. 233,539, now U.S. Pat. No. 4,401,979 assigned to the assignee of the present invention. The details of that particular circuit are herein incorporated by reference.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. An ionization smoke detector having a sensing chamber and comprising in combination:

(a) a screen electrode enclosing and forming the outer limits of said sensing chamber, while exposing said chamber to the ambient atmosphere through the openings defined therein;

(b) baffle means covering said screen electrode in close proximity thereto;

(c) said baffle means having a plurality of spaced, axially extending slit-like openings around the periphery thereof for permitting the transfer of said atmosphere from and to said sensing chamber;

(d) said baffle means including means for deflecting air currents directed normal to the peripheral surface of said baffle means such that the air currents enter said sensing chamber at an angle other than said normal angle and are concentrated at the periphery inside said chamber; said means for deflecting including each of said slit-like openings, said openings being skewed with respect to the radius of said sensing chamber such that they produce said deflection and concentration of said air currents.

2. The combination as set forth in claim 1, in which said means for deflecting deflects air currents moving substantially parallel to the plane on which said smoke detector is mounted.

3. The combination as set forth in claim 2, in which said baffle means includes additional openings for admitting air currents directed normal to the plane of mounting of said smoke detector into said sensing chamber, said additional openings being disposed in the vicinity of the outer periphery of said baffle means.

4. The combination as set forth in claim 1, in which the angle at which said slit-like openings are skewed is approximately 60° from the radius of said chamber.

5. The combination as set forth in claim 1, further comprising:

a first or inner electrode, and a second or intermediate electrode between said first electrode and said screen electrode.

6. The combination as defined in claim 5, in which said first electrode is mounted in a base; a first chamber region is defined by said base and said intermediate electrode; and a second region is defined by said intermediate electrode and said screen electrode.

* * * * *